United States Patent [19]

Welch

[11] 4,412,472

[45] Nov. 1, 1983

[54] MUSICAL INSTRUMENT CAPOTASTO

[76] Inventor: William G. Welch, 417 Dorothy NE., Albuquerque, N. Mex. 87123

[21] Appl. No.: 70,541

[22] Filed: Jun. 2, 1980

Related U.S. Application Data

[63] Continuation-in-part of Ser. No. 894,696, Apr. 10, 1978, abandoned.

[51] Int. Cl.[3] ..... G10D 3/04

[52] U.S. Cl. ..... 84/318

[58] Field of Search ..... 84/318

[56] References Cited

U.S. PATENT DOCUMENTS

| | | | |
|---|---|---|---|
| 577,627 | 2/1897 | Schuster | 84/318 |
| 583,102 | 5/1897 | Utt | 84/318 |
| 743,054 | 11/1903 | Bergren | 84/318 |
| 3,205,751 | 9/1965 | Lowe | 84/318 |
| 3,504,589 | 4/1970 | Wowries | 84/318 |
| 3,598,012 | 8/1971 | Dunlop | 84/318 |
| 3,933,073 | 1/1976 | Hutchins | 84/318 |
| 3,933,077 | 1/1976 | Dunlop | 84/318 |

*Primary Examiner*—Lawrence R. Franklin
*Attorney, Agent, or Firm*—Walter R. Keller

[57] ABSTRACT

A capotasto for musical instruments that have a finger board, of the guitar type, having an inelastic, tensioned holding strap for connection to the neck of the instrument. This strap, tensioned by a spring, permits repositioning of the capotasto on the neck of the instrument, by rolling without removing the capotasto; and the attachment of the capotasto will not detune the instrument. The capotasto includes two or more rollers on flexible pins to bear on the strings of the instrument to facilitate the repositioning of the capotasto.

6 Claims, 8 Drawing Figures

Inverted

Cross Section
Offset to describe roller

MUSICAL INSTRUMENT CAPOTASTO

This is a continuation-in-part of application Ser. No. 894,696 filed Apr. 10, 1979, now abandoned.

BACKGROUND OF THE INVENTION

1. Field of the Invention

This invention relates primarily to the clamp-like devices known as capotastos or capos which are applied to the neck of stringed instruments, especially guitars, mandolins and banjos, to shorten the effective length of the strings.

2. Description of the Prior Art

In prior art, the capotasto is usually comprised of a bar as a bearing surface with a variety of clamping devices, or straps to hold the capotasto on the instrument. The clamping devices or straps are such that in securing the capotasto to the neck of the instrument, force was applied which tended to move the capotasto ever so slightly in a direction transverse to the strings of the instrument; or the capotasto tended to rotate slightly about the neck of the instrument. This movement or rotation caused small displacement of the strings, and consequently made the instrument out of tune. In addition, some instruments have curved finger boards, and some have flat finger boards, and the capotasto could be repositioned to a different fret satisfactorily only by releasing the clamping device or strap, repositioning, and re-clamping, or re-strapping the capotasto. Hutchins, U.S. Pat. No. 3,933,073 uses a spring clamp. Hutchins, will not provide even pressure across the strings of an instrument whose neck is curved, but will instead rock; and since the pressure is applied to the strings from only one side of the device, the strings will be slightly displaced causing the instrument to be out of tune when attached. Dunlop U.S. Pat. No. 3,598,012, uses a traction strap which will fit almost all sizes of necks. However, the actuation of the toggle lever applies a friction force on the neck of the instrument causing a twisting of the capotasto and consequently de-tuning the instrument. Furthermore, Dunlop cannot easily be moved to another fret without releasing and repositioning the capotasto, and re-actuating the toggle lever. Wowries, U.S. Pat. No. 3,504,589, uses a pulley type system to apply a double force to the traction strap. Wowries, however, will not function on instruments with a curved neck, nor can it be repositioned to a different fret without releasing tension.

SUMMARY

The invention is an improved capotasto for use on stringed instruments such as a guitar, mandolin, or banjo. The capotasto has a traction strap adjustably and tensionably secured on each end of a body of the capotasto. The body supports two or more flexible roller pins. Each roller pin supports a roller which bears on the strings of the instrument.

An object of this invention is to minimize or eliminate the transverse displacement of the strings as the capotasto is attached to an instrument, and causing the instrument to be de-tuned thereby.

Another object of the invention is to eliminate the need for removing or releasing the capotasto when repositioning to a different fret is desired. A further objective is to provide a capotasto which will fit a variety of sizes and shapes of instruments without sacrificing performance. Alternative configurations for attaching the traction straps to the body of the capotasto fulfill the objective of versatile ease of attachment, and personal desires of the performer.

DESCRIPTION OF THE PREFERRED EMBODIMENT

Figure 1:
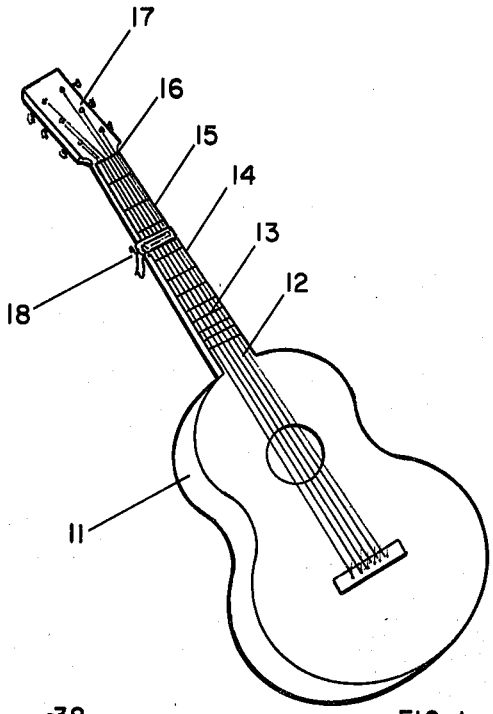
FIG. 1 is an isometric view of a musical instrument with invention.
Figure 4:
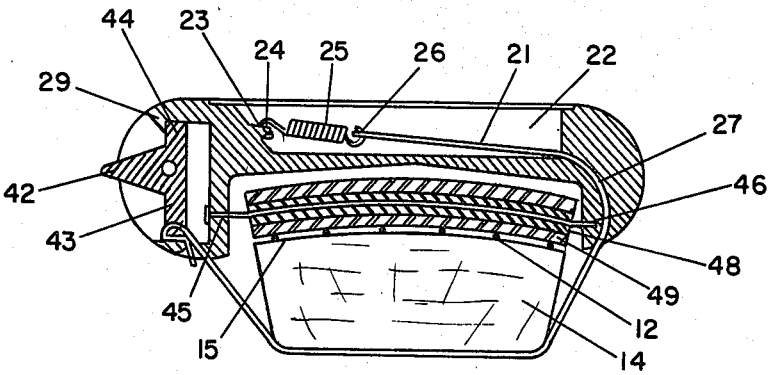
FIG. 4 is a crossection of FIG. 3 cut on 4—4.
Figure 2:
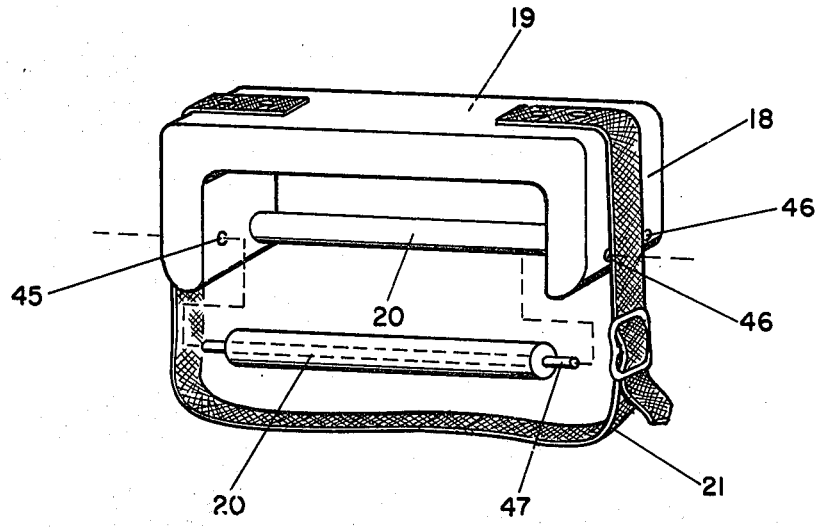
FIG. 2 is an isometric view of the invention with a generic body.

FIG. 1 shows this invention to be a capotasto 18 applied on a musical instrument 11 having strings 12, frets 13, neck 14, finger board 15, nut 16, and head 17. FIG. 2 shows the capotasto 18 having a body 19 supporting two rollers 20 for engagement of the strings 12, and the body 19 provides support for a traction strap 21 which secures the capotasto 18 to the neck 14 of the musical instrument 11. FIG. 4 shows the body 19 is formed so that the span is wide enough to permit the capotasto 18 to fit down over the neck 14 of the musical instrument 11.

The body 19 has two rollers pin holes 45 and two roller pins receptacles 46 axially aligned with the roller pin holes 45. Each roller pin 47 is press-fitted through one of the roller pin holes 45 and into one of the roller pin receptacles 46. Rotatably mounted on each roller pin 47 is a roller 20. Each roller 20 is made of two materials, a hard inner core 48 of Teflon type material and an outer covering 49 of soft resilient material such as rubber surgical tubing. The roller pins 47 are made of flexible, yet stiff material such as spring steel to permit the roller pins 47 and rollers 20 to bend slightly to fit musical instruments 11 with curved or flat finger boards 15. When the capotasto 18 is secured to the neck 14 of the musical instrument 11, by means hereinafter described, the rollers 20 bear on the strings 12 evenly. The rollers 20 being two or more prevent the capotasto 18 from tilting toward the head 17 or toward the sounding board of the instrument 11. In addition the rollers 20 act as wheels directing the capotasto 18 up and down the finger board 15 when moved, so that the rollers 20 are perpendicular to the strings 12 thus not permitting the capotasto 18 to cant at an angle other than perpendicular to the strings 12; thereby the strings 12 although fretted by the capotasto 18 are always in tune with each other. Additionally by having two or more rollers 20, the added tension on the strings 12 induced by the pressure of the rollers 20 is applied usually at two or more points between the frets 13 and the strings 20 need not be depressed fully to the fingerboard 15. This permits the instrument 11 to totally remain more nearly in key, but it is appreciated that the use of any capotasto 18 will to some degree detune the instrument 11. By applying as little pressure as possible and applying the pressure over several points of contact to the strings 12 in using the capotasto 18, the degree of detuning of the instrument 11 is minimized so that even when the sounds of the instrument 11 are amplified, the detuning effect of the capotasto 18 is not audible to the human ear.

The shape and functioning of the body 19 is important insofar as it provides the means for support of the traction strap 21 and the tensioning means of the traction strap 21. The capotasto 18 must be easily applied to the instrument 11, and easily removable therefrom; and yet when applied to the instrument 11, the capotasto 18 must be easily moveable along the finger board 15 and over the nut 16 while maintaining an even proper pressure on the strings 12. FIGS. 3, 4, 5, 6, 7, and 8, depict alternate configurations of the body 19 and the means for attaching and tensioning the traction strap 21, each alternative configuration meeting the basic requirements but having different additional advantages as will be apparent.

Figure 3:
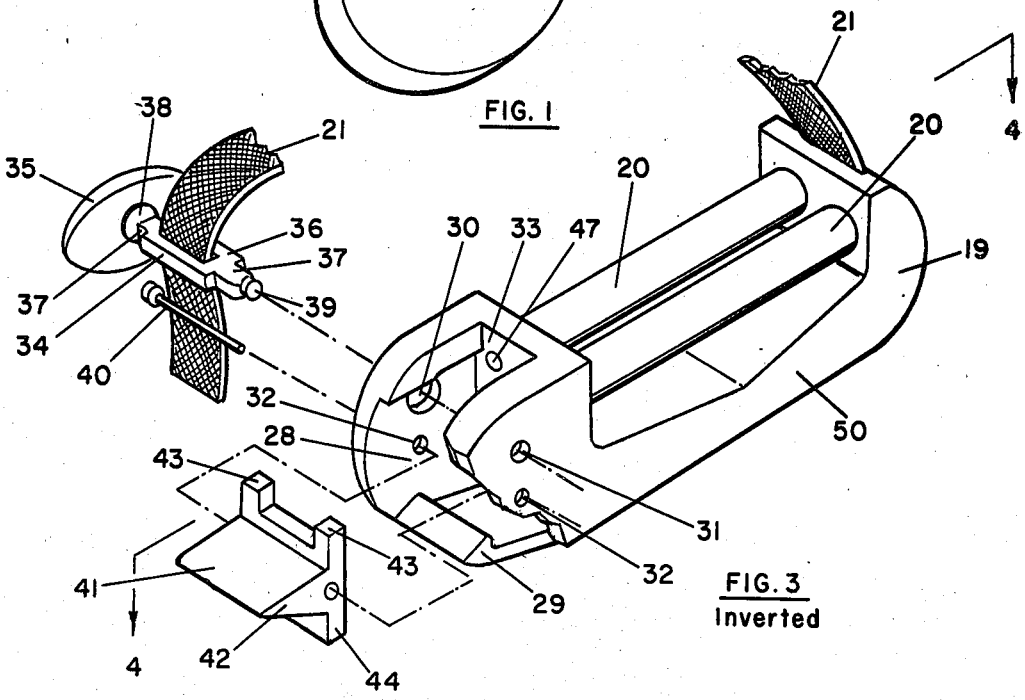
FIG. 3 is an inverted isometric view of the body with buckle chamber.

The first configuration of the body 19, is shown in FIGS. 3 and 4. The body 19 is shown to have a chassis 50 with an integrally formed spring recess 22 into which a spring mount 23 with a spring hole 24 protrudes. The spring mount 23 is also integrally formed as a part of the body 19. A coil spring 23 suitably sized to fit into the spring recess 22 hooks at one end through the spring hole 24. The other end of the coil spring 25 hooks into an eye 26 in a traction strap 21. The traction strap 21 is made of a suitable material such as woven nylon so that friction on the neck 14 of the musical instrument is minimized, and to prevent marring the finish. The body 19 has a curved traction strap slot 27 through one end. The traction strap 21 is threaded through the traction strap slot 27. The other end of the body 19 is formed into a buckle chamber 28 being approximately semi-cylindrical in shape. Integrally formed with and on the inside of the buckle chamber 28 is a lock-stop 29, which is a flange of generally triangular cross-section, said lock-stop being perpendicular to the ends of the semi-cylindrical buckle chamber 28. Through one end of the semi-cylindrical buckle chamber 28 is a buckle bushing hole 30 and through the other end of the semi-cylindrical buckle chamber 28 is a buckle mount hole 31. The buckle bushing hole 30 is larger than the buckle mounting hole 31 but they have centers on a common axis. The buckle chamber 28 also has two lockpin holes 32 which are axially aligned. The buckle chamber 28 is open on the semi-cylindrical surface from the lock-stop 29 through an angle of approximately ninety degrees away from the neck 14 of the musical instrument 11. The buckle chamber 28 has a strap access opening 33 into which the traction strap 21 passes. Inserted through the buckle bushing hole 30 is a buckle 34. The buckle consists of a knob 35 which fits flush against the outside end of the buckle chamber 28, a spool 36 which is slotted and enlarged for passing the traction strap 21 through, and for winding the traction strap 21, and eight locking flats 37 disposed four on each end of the spool 36, a buckle bushing 38 whose diameter is as large as the width of the spool 36 and sized to rotatably fit the bushing hole 30, and a snap cap 39 which is cylindrical with a flange on the end so that when forced through the buckle mounting hole 31 the flange on the snap cap 39 holds the buckle 34 in the buckle chamber 28. Through the lock-pin holes 32 passes a lock-pin 40 on which is rotatably mounted a lock 41. The lock 41 made of suitable material, such as that of the body 19, consists of the lock-lever 42, two lock posts 43 and a lock stop bar 44, all integrally formed. The lock-posts 43 are situated, so as, when properly positioned by the lock-lever 42, to fit the locking flats 37, thereby preventing rotation of the buckle 34.

Figure 5:
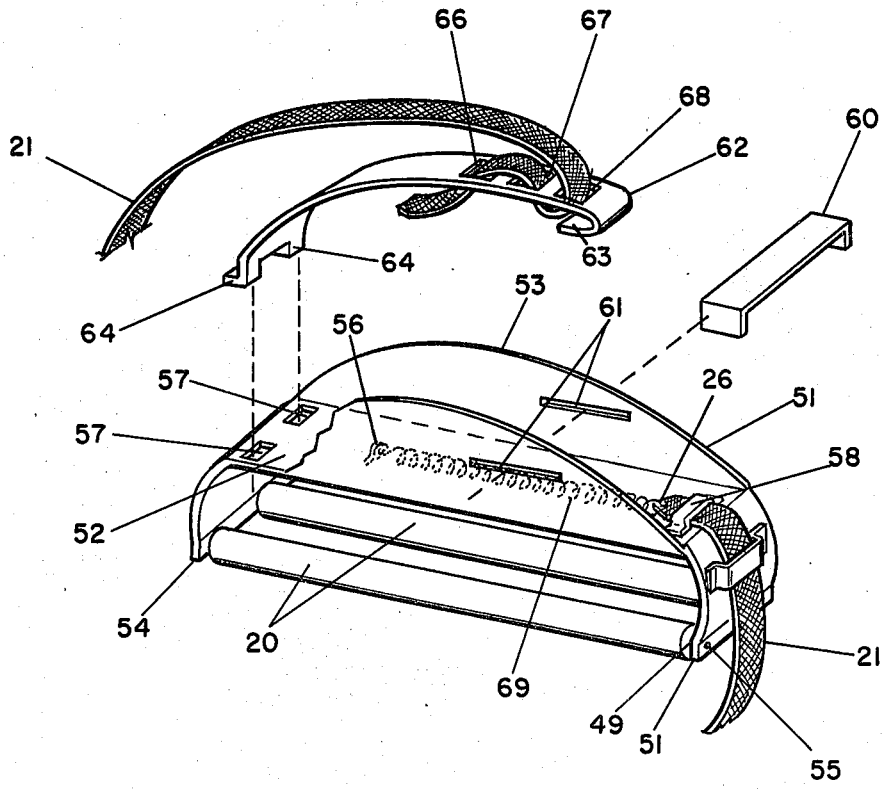
FIG. 5 is an exploded isometric view of the body with a channel bracket.

The second alternative configuration of the body 19 is shown in FIG. 5. The body 19 is shown to have a channel bracket 51 which is shaped to have a flat rectangular bottom 52, and two sides 53 which are pependicular to the bottom and the height of the sides 53 above the bottom varying from zero on the ends to a high point in the middle so as to form a circular arc. The channel bracket 51 also has two end pieces 54 normal to the bottom and protruding at ninety degrees from the bottom opposite in direction from the sides 53. The end pieces 54 have four spring holes 55, two in each end piece 54, into which the roller pins 47 are mounted. The body 19 is shown to have a spring hook 56 in the longitudinal center of the bottom 52, and two ear slots 57 adjacent to the edges of the bottom 52, near one end of the bottom 52. The ear slots 57 are rectangular holes. The spring hook 56 is a V-shaped integrally formed protrusion of the bottom 52, protruding away from the roller pins 47. At or near the other end of the bottom 52 is a strap guide 58 perpendicular to the longitudinal axis of the bottom 52. The strap guide 58 is an integrally formed protrusion away from the roller pins 47 through which the traction strap 21 is threaded thus holding the traction strap 21 in place. In FIG. 5 the body 19 is shown to have a cover release slide 60 and two cover release slots 61. The cover release slots 61, one in each side 53, are rectangular holes through which and in which the cover release slide 60 functions. The cover release slide 60 is a small metal bar or strip having its ends bent downward on the outside of the sides 53 sufficiently to prevent the cover release slide 60 from being removed and falling out of the release slots 61, yet the cover release slide 60 may slide in release slots 61. FIG. 5 also shows the body 19 to have a buckle cover 62 generally, a curved yet flat member, the curvature portion being arcuate to match the curvature of the edge of the sides 53. One end of the buckle cover 62 is bent U-shaped toward the concave side of the buckle cover 62 so as to form a slide latch 63. The other end of the buckle cover has two ears 64 adjacent to its edges shaped to have two rectangular protrusions approximately normal to the buckle cover 62. The ears 64 are sized to fit into and engage the respective ear slots 57. The buckle cover 62 has on its arcuate portion strap slots 66, 67, 68. In assembly as shown in FIG. 5, a helical tension spring 69 is hooked on one end into the spring hook 56 and the other end of the helical tension spring 69 is hooked into the eye 26 of the traction strap 21. The traction strap 21 is threaded under the strap guide 58. The other end of the traction strap 21 is threaded over the convex side of the buckle cover 62 down through a strap slot 66 to the concave side of the buckle 62, thence back through the buckle cover 62, via strap slot 67, and lastly back to the concave side of the buckle cover 62 through the strap slot 68. The traction strap 21 is adjusted to the proper length, and the ears 64 of the buckle cover 62 are inserted into the ear slots 57, and the buckle cover 62 is then depressed toward the channel bracket 51, and the release slide 60 slid into and engaging the slide latch 63. Thus assembled the traction strap 21 is properly tensioned by the helical tension spring 69, and the buckle cover 62 acts as a protector and cover for the helical tension spring 69 and conceals the ends of the traction strap 21. It is to be noted that the traction strap 21 is threaded onto itself between strap slots 67 and 68 and thereby secured.

Figure 6:
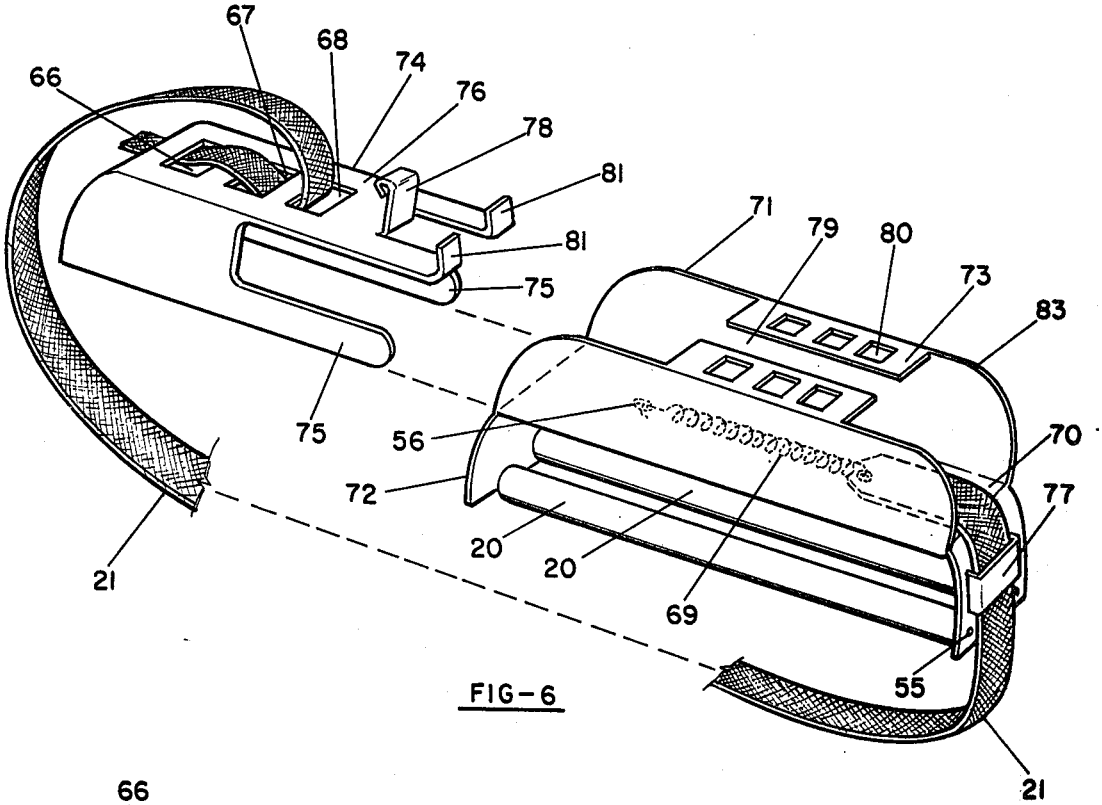
FIG. 6 is an isometric view of the body with a housing and spring slide.

FIG. 6 shows another alternative configuration of the body 19. The body 19 is shown to have a housing 83 and a spring slide 74. The housing 83 has a rectangular bottom 70, two sides 71, two end pieces 72, and two channel tops 73 all integrally formed of rigid material. A spring slide 74 having two runners 75 integrally formed with a lever lid 76 and a lever lip 78, engages the housing 83. The bottom 70 of the housing 83 has a spring hook 56, integrally formed therein either as a protrusion or a protrusion with an eye, on the longitudinal axis of the bottom 70. At the ends of the bottom 70, the end pieces 72 are formed to present a rounded shoulder in contrast to a sharp corner, where the end pieces 72 join the bottom 70. The end pieces 72 generally protrude perpendicular to the bottom 70. On the inside of the end pieces 72 are four spring holes 55, two in each end piece 72, into which the roller pins 47 with rollers 20 are installed. Integrally formed on the outside of each end piece 72 is a strap guide 77, sized to accept a traction strap 21. Integrally formed with the bottom 70 and end pieces 72 are two sides 71 extending perpendicular to the bottom 70, in opposite direction to the end pieces 72, along the long edges of the rectangular bottom 70. The sides 71 are of any convenient height. Again, integrally formed with the sides 71 are the channel tops 73. The channel tops 73 are flat surfaces, each extending from the top of a side 71 toward the other side 71 parallel to the bottom 70, but not meeting the opposing channel top 73, thus leaving a gap 79 between the channel tops 73. Each channel top 73 has a series of rectangular holes through it designated retaining holes 80. The spring slide 74 is shown to have a lever lid 76 having a plurality, three or more, strap slots 66, 67, 68 sized to accept the traction strap 21. The lever lid 76 also has at one end integrally formed therewith a vertically protruding lever lip 78 which is generally reactangular and whose length is sized to slide in the gap 79. On the edges of the lever lid 76 at the same end as the lever lip 78, and on each side of the lever lip 78 are lock hooks 81 which also generally protrude upward and are sized to fit the retaining holes 80. Integrally formed with and along each side of the lever lid 76 and extending perpendicular to the plane of the lever lid 76 are the runners 75. The runners 75 are generally flat members connected to the lever lid 76 near the opposite end thereof from the lever lip 78. The runners 75 protrude in the direction of the lever lip 78. The spring slide 74 is sized to be inserted into the housing 83 so that the runners 75 slide along the bottom 70 and the lock hooks 81 engage the retaining holes 80. In a manner similar to the previous configurations, a traction strap 21 is attached on one end to the bottom 20 by a helical spring 69. The traction strap 21 is threaded through both strap guides 77 and then threaded through the strap slots 66, 67, 68. The spring slide 74 is then slideably mated with the base 19. To release the spring slide 74, one depresses the lever lip 78 which deflects the cantilevered lock hooks 81 thus freeing the spring slide 74 to be removed by sliding from the housing 83. It is obvious that the retaining holes 80 could be replaced by ridges or ratchet like teeth on the under side of the channel tops 73 and engage mating lock hooks or ratchet like teeth on the spring slide 74 to perform the function of securing the spring slide 74 in the housing 83.

Figure 7:
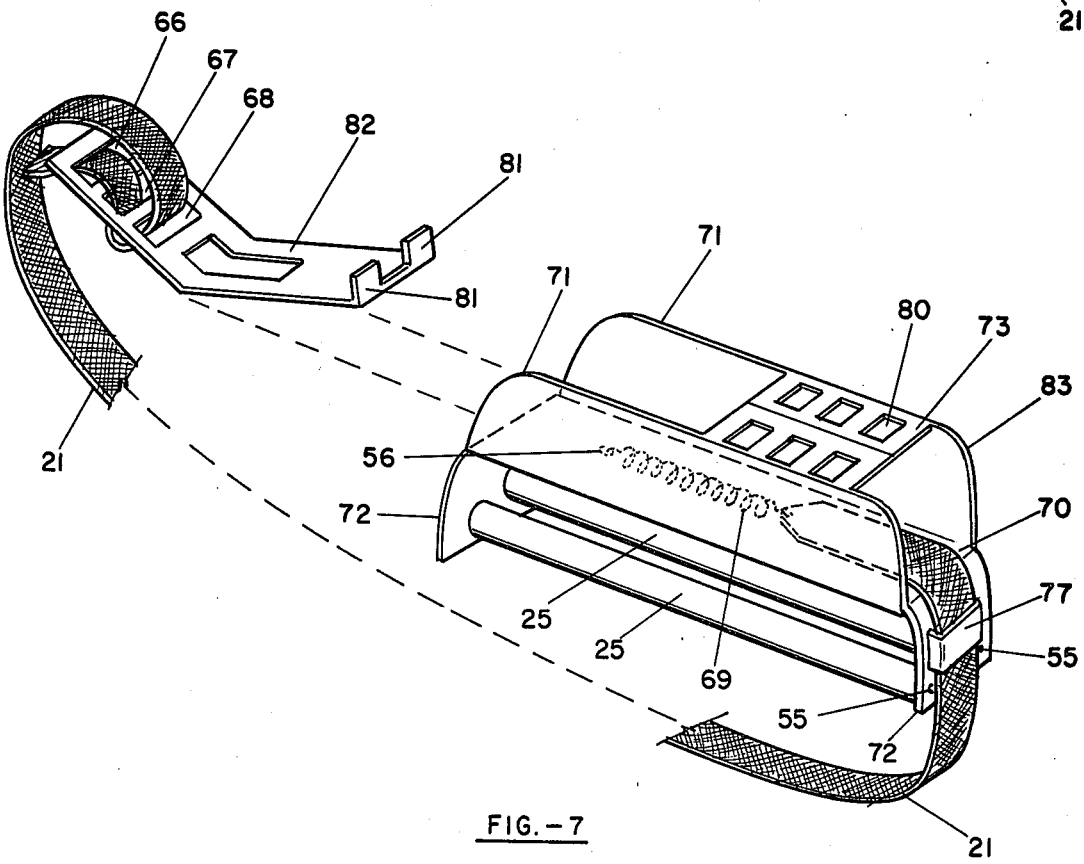
FIG. 7 is an isometric view of the body with a housing and spring slide

FIG. 7 shows an alternate configuration wherein the spring slide 74 is replaced by a pivot lever 82. The pivot lever is generally a V shaped flat member having the strap slots 66, 67 and 68 on one arm of the V and the lock hooks 81 on the other arm of the V. The pivot lever 82 is sized to slide into and engage the housing 83. Again the traction strap 21 is threaded over one arm of the V into and through the strap slots 66, 67 and 68. The pivot lever 82 is slideably mated to the housing 83 so that the vertex of the V slides along the bottom 70 of the housing 83. Properly adjusted the traction strap 21 is under tension, thereby applying a force and tipping moment to the pivot lever 82 causing the lock hooks to engage the retaining holes 80.

Figure 8:
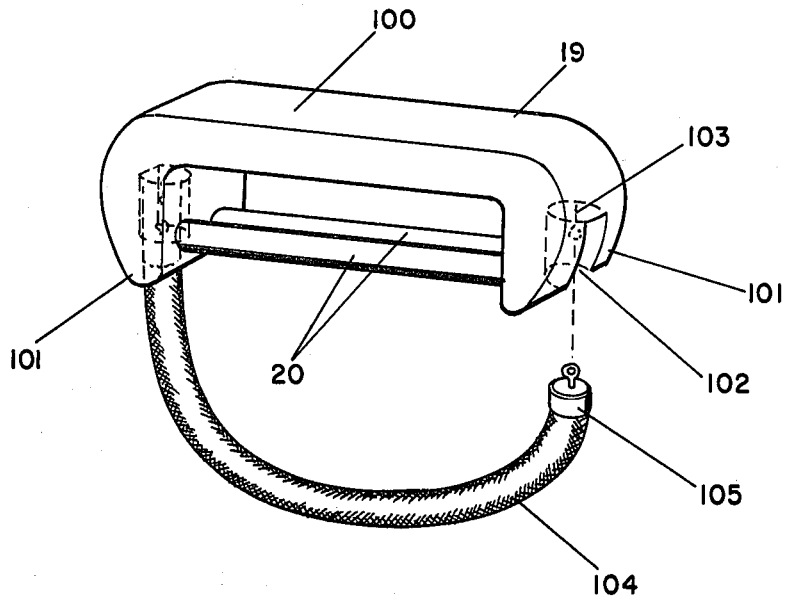
FIG. 8 is an isometric view of the body having swivels and bungee cord.

FIG. 8 shows the final alternative configuration of the body 19. FIG. 8 shows the body 19 to have a frame 100 being generally a rectangular prism in shape having integrally formed therewith two butt supports 101 on each end thereof protruding downward. On the inside of each butt support 101 are two roller pin holes 55 into which the two rollers pins 47 with rollers 20 are installed. Each butt support 101 has formed therein on the outside, a cavity 102 bieng generally semi-cylindrical in shape but curving smoothly toward the other butt support 101 at the free end thereof. Integrally formed on the bottom of the frame 100 on the roof of the cavity 102 is a swivel eye 103. The traction strap 21 of previous configurations is not used, but functionally replaced by a bungee cord 104, of round cotton wrapped elastic material such as rubber. Each end of the bungee cord is mounted into a swivel 105 having a full three hundred sixty degrees of rotation. The bungee cords 104 with swivels 105 are to be manufactured in a variety of lengths to provide a variety of tensions and fit a variety of instruments. Each swivel 105 hooks into one of the swivel eyes 103. Applied to the instrument 11 the capotasto 18 is secured thereto by the tension in the bungee cord 104. If the musician desires to move the capotasto 18 up or down the finger board 15, the bungee cord 104 will roll on the underside of the neck 14 as the rollers 20 roll up or down the strings 12. The configuration eliminates sliding of the traction strap, and eventual wear of the finish of the neck. It would be obvious to adapt this configuration with a means for adjusting the tension in the bungee cord 104 by moving one or both of the swivel eyes 103 by means of adjustable levers or slides in a manner similar to the prior configurations.

I claim:

1. A capotasto, for use in connection with a string instrument with a neck including a finger board and strings therealong, said capotasto comprising a body having mounted therein two or more rigid but flexible roller pins each pin having rotatably mounted thereon rollers; said rollers being generally cylindrical in shape and said rollers having a hard inner core and a soft resilient outer core; and said capotasto having a traction strap and means for attaching and tensioning the traction strap around the neck of the string instrument so that the rollers of the capotasto bear on the strings of the instrument.

2. The capotasto of claim 1 wherein the body comprises a recess to which a spring is attached, and the spring is attached to one end of the traction strap, and the body has a buckle chamber with a spool with locking flats mounted therein, and the body has a lock consisting of lock-lever, two lock posts and lock stop bar, whereby the unattached end of the traction strap is inserted in to the buckle chamber through an access opening provided therefore and the traction strap is threaded through a slot in the spool and wound thereon until sufficient tension is provided by the pull on the spring by the traction strap, whereupon the lock lever is depressed positioning the lock posts of the lock against the locking flats on the spool.

3. The capotasto of claim 1 wherein the body comprises a channel bracket having a rectangular bottom, and two flat perpendicular sides arcuate in shape, and wherein said channel bracket has two end pieces which support the roller pins and rollers and said channel bracket has a spring hook formed in the rectangular bottom and wherein said channel bracket has two ear slots in the rectangular bottom adjacent to the edges of the bottom near one end of the bottom, and wherein said channel bracket has on the rectangular bottom, a strap guide, and wherein said channel bracket has in each side, a cover release slide installed; and said body also comprising a buckle cover being a flat yet curved member and said buckle cover having a U-shaped end and a straight end with two ears adjacent to the edges of the said buckle cover sized to insert into the ear slots, and wherein said buckle cover has three or more strap slots; and the body further comprising a tension spring which is attached on one end to the spring hook and the other end to an eye in the traction strap, the traction strap then is threaded through the strap guide and around and under the neck of the musical instrument and the other end of the traction strap is threaded over the convex surface of the buckle cover and through the strap slots, and the buckle cover is then engaged with the channel bracket by inserting the ears into the ear slots and sliding the release slide into and engaging the U-shaped end of the buckle cover.

4. The capotasto of claim 1 wherein the body comprises a housing and a slide, wherein the said housing has a rectangular bottom, two sides, two channel tops, and two end pieces which support the roller pins and rollers, and wherein the two channel tops have a plurality of rectangular retaining holes, and wherein the two channel tops have a gap between them, and wherein the rectangular bottom has a spring hook formed therein; and wherein the slide has two runners integrally formed with a lever lid and a lever lip; the lever lid has on each side lock hooks protruding upward and the lever lid has a plurality of strap slots; and the body further comprising a spring attached at one end to the spring hook and the other end to one end of the traction strap; the other end of the traction strap is threaded through the strap slots and the slide is inserted into the housing so that the lock hooks engage the retaining holes, and depressing the lever lip disengages the lock hooks from the retaining holes.

5. The capotasto of claim 1 wherein the body comprises a housing and a pivot lever, wherein the housing has a rectangular bottom, two sides, two channel tops and two end pieces which support the roller pins and rollers, and wherein the two channel tops have a plurality of rectangular retaining holes, and the rectangular bottom has a spring hook formed therein; and wherein the pivot lever being generally a V-shaped flat member, has a plurality of strap slots on one arm of the V and has lock hooks on the other arm of the V; and wherein the body has a spring which attaches at one end to the spring hook and the other end to a traction strap, the traction strap then passes around and under the neck of the musical instrument and is threaded into the strap slots and the pivot lever is then slid into the housing so that the lock hooks engage the retaining holes, and the tension thereby induced in the traction strap creates the moment required to pivot the pivot lever thus maintaining the lock hooks engaged in the retaining holes.

6. The capotasto of claim 1 wherein the body comprises a frame having two butt supports integrally formed on each end of the frame; the butt supports, protrude downward from the frame, each have a plurality of roller pin holes which support the roller pins and rollers, and each butt support has a smooth cavity on the outside; and wherein the cavities, being generally semi-cylindrical in shape, having a roof, and integrally formed into the roof of each cavity is a swivel eye; and wherein a bungee cord, being of cotton wrapping round elastic material and having a full rotational swivel and hook on each end, is attached to the frame by hooking each hook to one of the swivel eyes.

* * * * *